US010191401B2

(12) United States Patent
Shimizu

(10) Patent No.: US 10,191,401 B2
(45) Date of Patent: Jan. 29, 2019

(54) IMAGE FORMING APPARATUS

(71) Applicant: BROTHER KOGYO KABUSHIKI KAISHA, Nagoya-shi, Aichi-ken (JP)

(72) Inventor: Yoshikazu Shimizu, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/024,625

(22) Filed: Sep. 11, 2013

(65) Prior Publication Data

US 2014/0086658 A1 Mar. 27, 2014

(30) Foreign Application Priority Data

Sep. 26, 2012 (JP) ..... 2012-212847

(51) Int. Cl.
*B41J 29/02* (2006.01)
*G03G 15/00* (2006.01)
*G03G 21/16* (2006.01)

(52) U.S. Cl.
CPC ..... *G03G 15/00* (2013.01); *G03G 21/1619* (2013.01); *G03G 2215/0141* (2013.01)

(58) Field of Classification Search
CPC ..... G03G 21/1619; G03G 2221/1678; G03G 15/00; B41J 29/02
USPC ..... 399/393, 124; 400/691–693
See application file for complete search history.

(56) References Cited

U.S. PATENT DOCUMENTS 6,571,073 B1 * 5/2003 Suzuki et al. ..... 399/116
2005/0047828 A1 * 3/2005 Kawai ..... 399/126
2007/0196150 A1 * 8/2007 Kobayashi ..... G03G 15/6502 399/393

(Continued)

FOREIGN PATENT DOCUMENTS

JP 2004-29620 A 1/2004
JP 2010-052423 A 3/2010

(Continued)

OTHER PUBLICATIONS

Title: Matweb Resin Strengths URL: http://www.matweb.com/reference/tensilestrength.aspx (accessed Dec. 9, 2014).*

(Continued)

*Primary Examiner* — Jill E Culler
*Assistant Examiner* — Ruben C Parco, Jr.
(74) *Attorney, Agent, or Firm* — Merchant & Gould P.C.

(57) ABSTRACT

An image forming apparatus has an image forming unit configured to form an image on a sheet, a first frame having a plate-like shape and made of metal, the first frame being configured to support the image forming unit, a second frame arranged on an opposite side, with respect to the first frame, of the first frame with sandwiching the image forming unit therebetween, the second frame having a plate-like shape and made of resin, the second frame being configured to support the image forming unit in association with the first frame, a third frame bridging between the first frame and the second frame, a sheet supplying unit being secured to the third frame, and a contacting part formed to each of the first frame and the second frame, contact parts formed to the third frame being configured to contact the first and second frames, respectively.

5 Claims, 7 Drawing Sheets

(56) References Cited

U.S. PATENT DOCUMENTS

| | | | | |
|---|---|---|---|---|
| 2008/0168918 | A1* | 7/2008 | Shimizu | F16C 3/02 101/407.1 |
| 2009/0184464 | A1* | 7/2009 | Fujita | B65H 5/025 271/273 |
| 2010/0019443 | A1 | 1/2010 | Ichikawa | |
| 2010/0080612 | A1* | 4/2010 | Nakashima | 399/111 |
| 2010/0215419 | A1 | 8/2010 | Souda | |
| 2011/0085818 | A1* | 4/2011 | Ukai | 399/92 |
| 2011/0101600 | A1* | 5/2011 | Chihara | B65H 1/14 271/152 |
| 2011/0102983 | A1* | 5/2011 | Souda | G03G 21/1619 361/679.01 |

FOREIGN PATENT DOCUMENTS

| | | | |
|---|---|---|---|
| JP | 2010-197653 | A | 9/2010 |
| JP | 2012-73284 | A | 4/2012 |

OTHER PUBLICATIONS

Title: Definition of frame; URL: https://www.merriam-webster.com/dictionary/frame, dated Aug. 27, 2017.*

Notification of Reasons of Rejection issued in related Japanese Patent Application Serial No. 2012-212847, dated Feb. 9, 2016.

Decision of Rejection in related Japanese Patent Application No. 2012-212847, dated Sep. 13, 2016.

* cited by examiner 25E
25A
25F
25
27
A
23
29A(29)
29B
UP
FRONT
LEFT
(WIDTH DIRECTION)
REAR
RIGHT
DOWN 29A
27A
25
31
29B
27A

IMAGE FORMING APPARATUS

CROSS-REFERENCE TO RELATED APPLICATION

This application claims priority under 35 U.S.C. § 119 from Japanese Patent Application No. 2012-212847 filed on Sep. 26, 2012. The entire subject matter of the application is incorporated herein by reference.

BACKGROUND

Technical Field

Prior Art

A conventional image forming apparatus is typically configured such that a pair of frames is provided on opposite sides of an image forming unit, which is configured to form an image on a sheet, and a sheet feed frame are secured to the pair of frames.

SUMMARY

According to a conventional configuration as described above, since the image forming unit, the sheet feed frame and the like are secured to the pair of frames, the frames are typically made of metal in order to provide necessary rigidity. In view of a manufacturing cost, design freedom and productivity, however, it is desirable to employ resin frames.

However, the resin frames generally have lower rigidity than metal frames, and therefore, it is difficult to maintain accuracy in positions of the image forming unit, sheet feed frames and the like.

In consideration of the above, aspects of the invention provide an improved image forming apparatus which provides high propriety in terms of positional accuracy in assembling the sheet feed frame and the like to the main frames, reduction of manufacturing cost of the image forming apparatus, design freedom and productivity.

According to aspects of the invention, there is provided an image forming apparatus, which has an image forming unit configured to form an image on a sheet, a first frame having a plate-like shape and made of metal, the first frame being configured to support the image forming unit, a second frame arranged on an opposite side, with respect to the first frame, of the first frame with sandwiching the image forming unit therebetween, the second frame having a plate-like shape and made of resin, the second frame being configured to support the image forming unit in association with the first frame, a third frame bridging between the first frame and the second frame, a sheet supplying unit being secured to the third frame, and a contacting part formed to each of the first frame and the second frame, contact parts formed to the third frame being configured to contact the first and second frames, respectively.

As the contact parts provided to third frame contact the contacting parts provided to the first and second frames, a relative position of the third frame with respect to the first frame and the second frame is defined.

Since the first frame is made of metal, the position of the third frame is mainly determined by the first frame which has a higher rigidity than the second frame.

BRIEF DESCRIPTION OF THE ACCOMPANYING DRAWINGS

DETAILED DESCRIPTION OF THE EMBODIMENT

Hereinafter, an exemplary embodiment according to aspects of the invention will be described. It is noted that concrete components and structures of the exemplary embodiment are not intended to limit the scope of the invention.

General Description of Image Forming Apparatus

Figure 1:
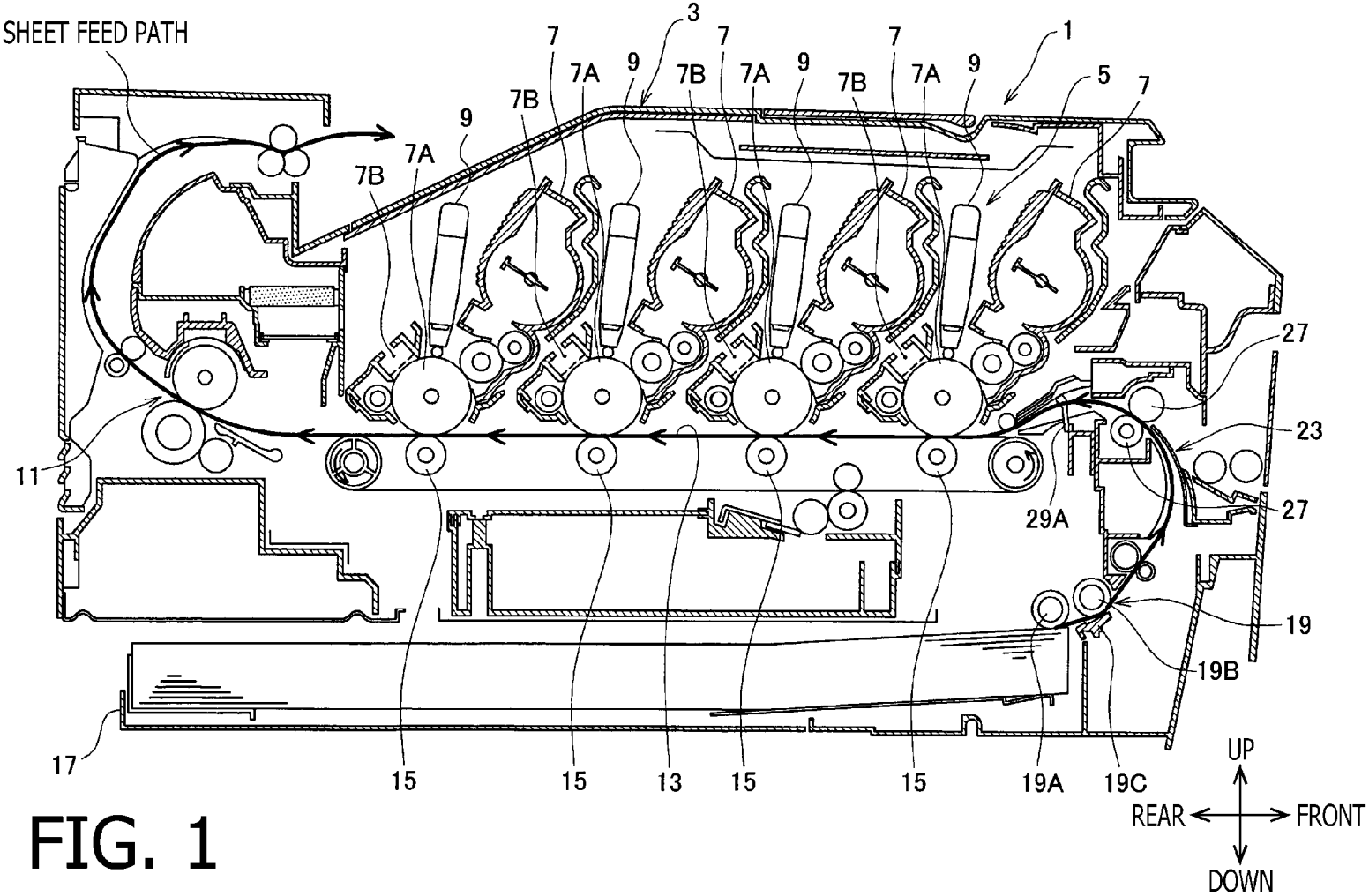
FIG. 1 is a cross-sectional side view of an image forming apparatus according to an exemplary embodiment of the invention.

An image forming apparatus 1 according to an exemplary embodiment has a housing 3 which accommodates an image forming unit 5 as shown in FIG. 1. The image forming unit 5 is configured to form an image on a sheet (e.g., a printing sheet) in accordance with an electrophotographic image forming process. The image forming unit 5 has process cartridges 7, exposure units 9, a fixing unit 11 and the like.

It is noted that the image forming unit 5 according to the embodiment is configured as a so-called direct tandem type image forming unit which is provided with a plurality of (e.g., four) process cartridges 7 arranged in a direction perpendicular to axes of photoconductive drums 7A (which will be described later).

Each process cartridge 7 is detachably coupled to a main body of the image forming apparatus 1. The plurality of process cartridges 7 have substantially the same structures, and only colors of developing agents (e.g., toner) accommodated in the plurality of process cartridges 7 are different. Each process cartridge 7 has a photoconductive drum 7A, a charger 3B and the like.

Figure 2:
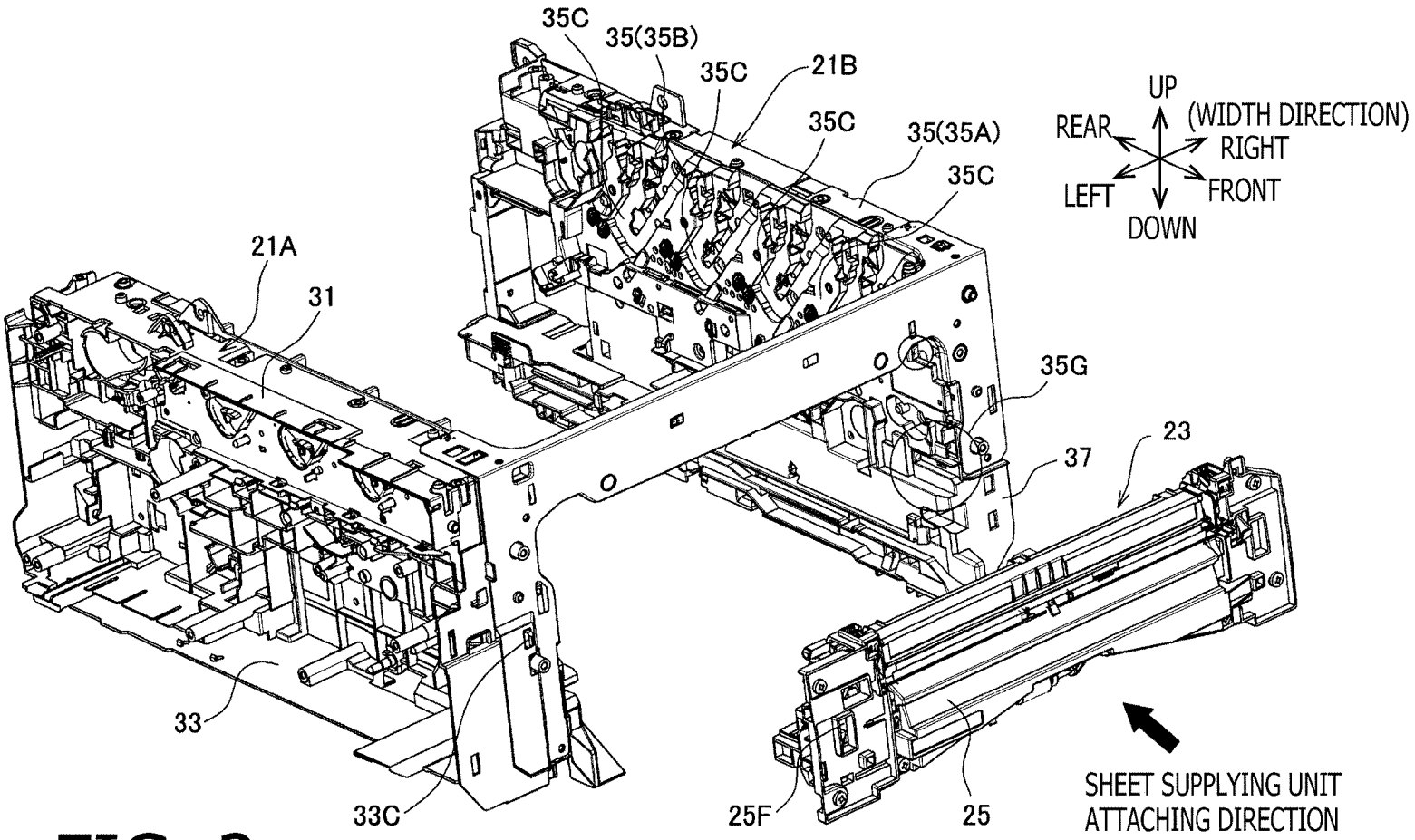
FIG. 2 is a perspective view showing a pair of main frames and a sheet supplying unit according to the exemplary embodiment of the invention.

The main body of the image forming apparatus 1 includes the housing 3, a pair of main frames 21 and the like, which will not be taken apart by a user of the image forming apparatus 1. The pair of main frames 21A and 21B includes plate-like members facing each other, in a width direction (which is perpendicular to a plane of FIG. 1), with a space therebetween as shown in FIG. 2. It is noted that the "width direction" is also a direction parallel with the axes of the photoconductive drums 7A.

The components of the image forming unit 5, such as the process cartridges 7, are arranged between the main frames 21A and 21B, and secured thereto.

The photoconductive drums 7A are configured to bear images formed by the developing agent (e.g., toner images), which are transferred to the sheet. The chargers 3B are used to charge the circumferential surfaces of the photoconductive drums 7A, respectively. The exposure units 9 cause the charged surfaces of the photoconductive drums 7A to be exposed to light which is modulated based on image data so that electrostatic latent images are formed on the photoconductive drums 7A, respectively. Each of the photoconductive drums 7A is arranged such that the axis thereof is perpendicular to a sheet feeding direction, and the plurality of photoconductive drums 7A are arranged, in series, along a direction parallel to the sheet feed direction as shown in FIG. 1.

At positions opposite to the photoconductive drums 7A with a transfer belt 13 therebetween, transfer units 15 configured to cause the images formed by the developing agents (e.g., toner images) to be transferred onto a sheet. As is well known, the plurality of images formed by the developing agents having different colors respectively carried by the plurality of photoconductive drums 7A are transferred on the sheet fed by the transfer belt 13 in an overlapped manner so that image of respective color components are overlapped to form one color image. The transferred images formed by the developing agents are heated and fixed on the sheet by the fixing unit 11.

Below the transfer belt 13, a sheet supply tray 17 is provided. In the sheet supply tray 17, a plurality of sheets are placed in a stacked manner. The plurality of sheets accommodated in the sheet supply tray 17 are fed by a feeder mechanism 19 one by one. According to the exemplary embodiment, a sheet feeding mechanism 23 feeds the sheet supplied by the feeder mechanism 19 toward the image forming unit 5.

The feeder mechanism 19 includes a pickup roller 19A, a separation roller 19B and a separation pad 19C. The pickup roller 19A applies a feeding force to the sheet placed in the sheet supply tray 17. The separation roller 19B, in association with the separation pad 19C, separates one sheet from a plurality of overlapped sheets.

Sheet Feeding Mechanism

Figures 3A, 3B:
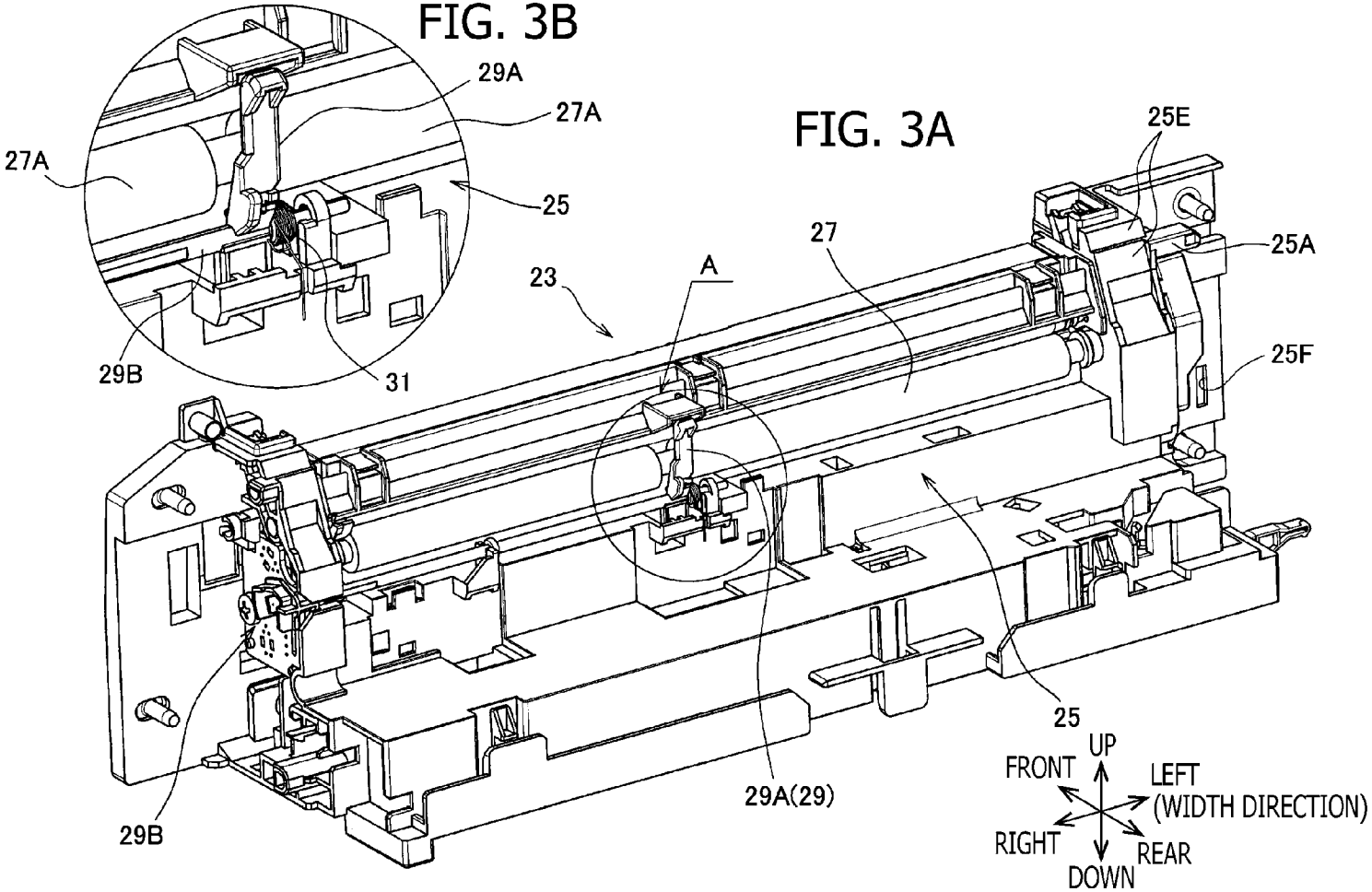
FIG. 3A is a perspective view of the sheet supplying unit according to the exemplary embodiment of the invention.
FIG. 3B is an enlarged view of a circled part of FIG. 3A.

The sheet feeding mechanism 23 is provided to a sheet supplying frame 25 as shown in FIG. 3. The sheet supplying frame 25 is a beam-like member extending in the width direction between the pair of main frames 21A and 21B as shown in FIG. 2.

The sheet supplying frame 25 rotatably supports a pair of rollers 27 which feed the sheet supplied by the feeder mechanism 19. According to the exemplary embodiment, the separation roller 19B of the feeder mechanism 19 is also coupled to the sheet supplying frame 25.

The pair of rollers 27 also serves as register rollers which correct attitude (i.e., feeding direction) of the sheet in addition to a sheet feeding function. That is, the pair of rollers 27 tentatively pauses feeding of the sheet which is supplied by the feeder mechanism 19 to correct the orientation of the sheet. Thereafter, in accordance with a predetermined timing, the pair of rollers 27 restarts feeding the sheet to the image forming unit 5.

On a downstream side, in the sheet feed direction, of the pair of rollers 27, an actuator 29 is provided. The actuator 29 has at least a contacting member 29A and a detecting unit 29B. The contacting member 29A rocks as it contacts the sheet having been fed. The detecting unit 29B detects a position of the contacting member 29A.

The sheet supplying frame 25 are arranged between and on the front side of the main frames 21A and 21B, and secured thereto, as shown in FIG. 2. According to the exemplary embodiment, a pair of rollers 27 is coupled to the sheet supplying frame 25 so as to be treated as a sub-assembly. Therefore, by coupling the sheet supply unit 25 as the sub-assembly to the main frames 21A and 21B, assembling of the sheet feeding mechanism 23 is completed.

Configuration of Main Frames

The main frame 21A has a first frame 31 which is formed to have a substantially plate-like shape and made of metal, and a first body frame 33 which is made of resin and coupled to the first frame 31.

The first frame 31 and the first body frame 33 are coupled with mechanical fastening members such as a screw. According to the exemplary embodiment, the first frame 31 is made of ferrous metal such as SPCC (Steel Plate Cold Commercial), and the first body frame 33 is made of ABS (Acrylonitrile-Butadiene-Styrene).

The main frame 21B is arranged at a position opposite to the first frame 31 with the image forming unit 5 sandwiched therebetween, and supports the image forming unit 5 in association with the main frame 21A. The main frame 21B has a substantially plate-like second frame made of resin, and a second body frame 37 which is made of resin and coupled to the second frame 35.

The second frame 35 has a first resin part 35A made of first resin and a second resin part 35B made of second resin. According to the exemplary embodiment, the second resin has a higher tensile strength than the first resin. Specifically, the first resin is ABS (acrylonitrile-butadiene-styrene copolymer) and the second resin is PC/AS (blend of polycarbonate and polyacrylonitrile-ran-styrene).

According to the exemplary embodiment, the second body frame 37 is made of PS (polystyrene). The second body frame 37 is secured to the second resin part 35B with a mechanical fastening member such as a screw, and the first resin part is also secured to the second resin part 35B also with a mechanical fastening member such as a screw.

The second resin part 35B is arranged on the main frame 21A side with respect to the first resin part 35A. A coupling part 35C to which the image forming unit 5 including the process cartridges 7 is coupled, and second contacting parts 35D and 35E, which will be described later, are provided to the second resin part 35B.

Figure 4:
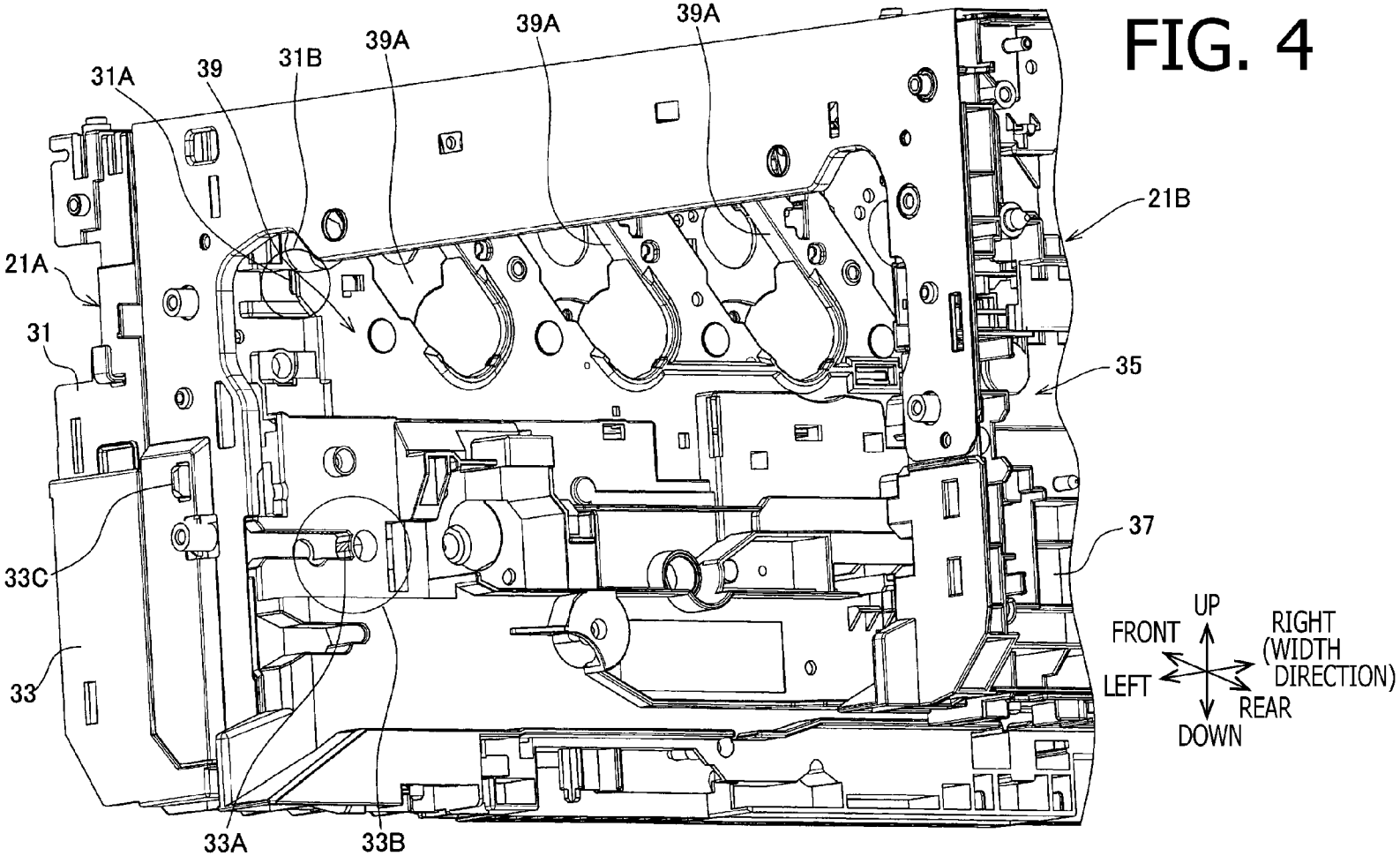
FIG. 4 shows a rear side of the main frames according to the exemplary embodiment of the invention.

On the main frame side 21B of the first frame 31, a plate part 39 made of resin is coupled, as shown in FIG. 4. The resin forming the plate part 39 has substantially the same tensile strength as the second resin. The plate part 39 has a coupling part 39A to which the image forming unit 5 including the process cartridges 7 is coupled.

Incidentally, the coupling part 39A has a complicated shape. Therefore, in order to form such a coupling part 39A on the first frame 31, which is made of metal, a die casting method or a cutting method should be employed, which would increase a manufacturing cost of the main frame 21A, instead of a press-molding method. Therefore, according to the exemplary embodiment, the plate part 39 having the coupling part 39A is made of resin which can easily be formed to have a desired shape, and such a plate part 39 is coupled to the first frame 31.

Positioning of Sheet Supplying Frame

The sheet supplying frame 25 is secured to the main frames 21A and 21B, with mechanical fastening members such as screws, with being positioned with respect to the first frame 31 and the second frame 35.

Figure 6:
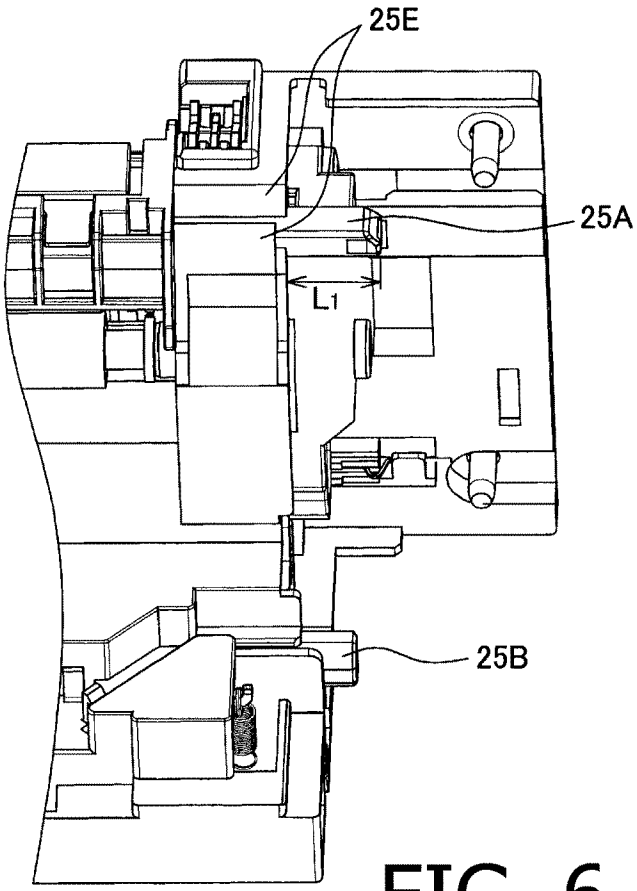
FIG. 6 is an enlarged view of end portions, in a longitudinal direction, of the sheet feeding unit according to the exemplary embodiment of the invention.
Figure 6:
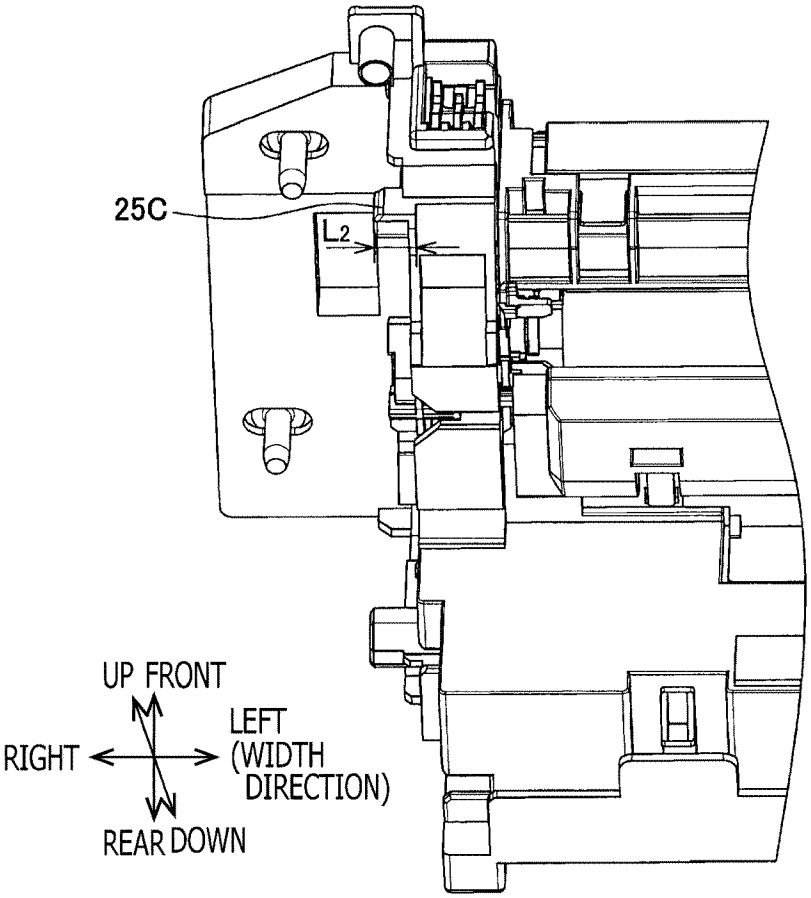

Specifically, the first frame 31 is provided with the first contacting part 31A as shown in FIG. 4. The sheet supplying frame 25 is provided with a pair of first contact parts 25A and 25B as shown in FIG. 6, and the first contact part 25A contacts the first contacting part 31A of the first frame 31. The first contact part 25B contacts the first contacting part 33A provided to the first body frame 33 as shown in FIG. 4.

Figure 5:
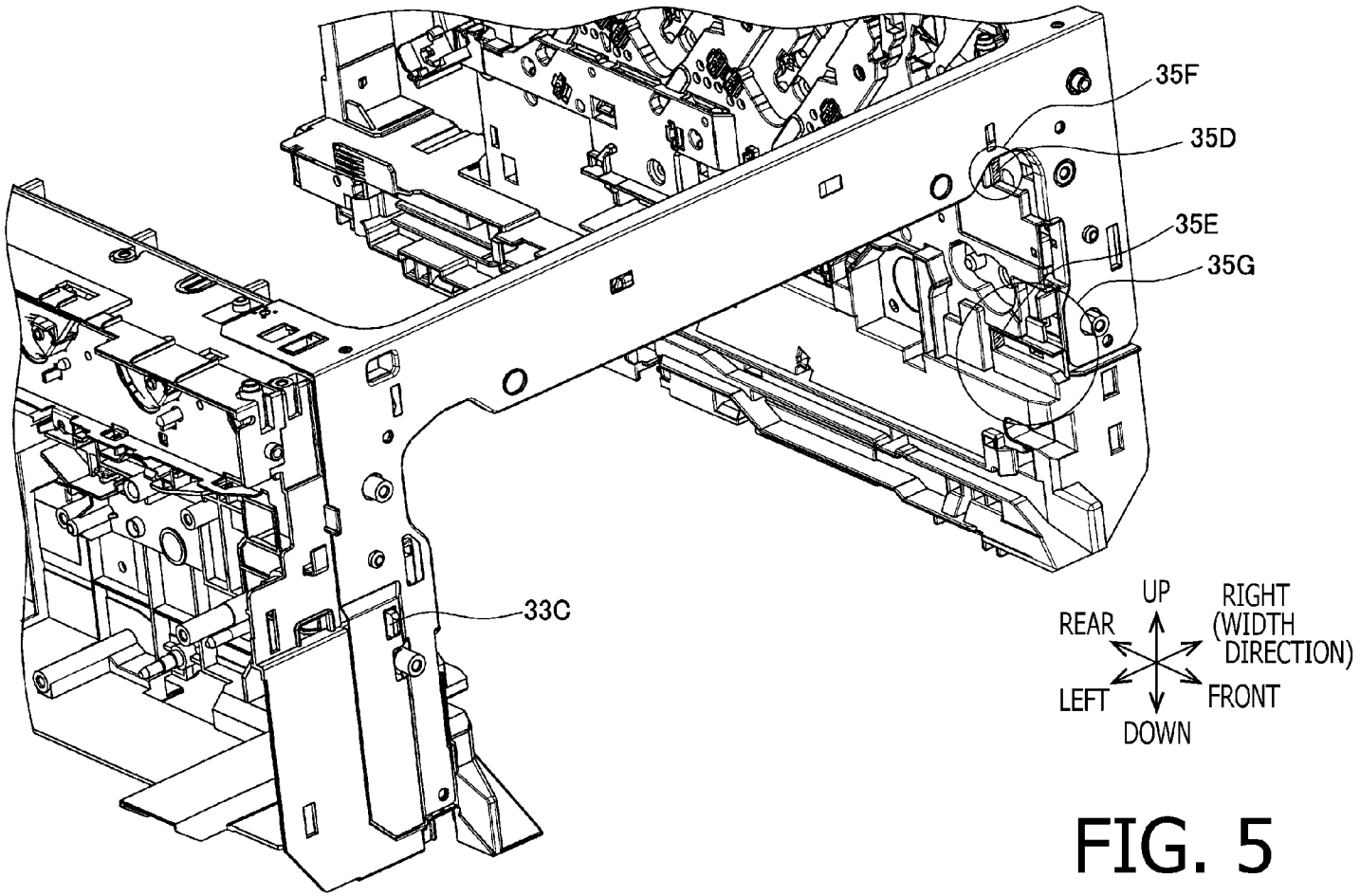
FIG. 5 shows a front side of the main frames according to the exemplary embodiment of the invention.

The second frame 35 is formed with second contacting parts 35D and 35E as shown in FIG. 5. The second contacting parts 35D and 35E contact second contact parts 25C and 25D which are shown in FIG. 6.

The first contact parts 25A and 25B, and the second contact parts 25C and 25D contact the first contacting part 31A and 33A, and the second contacting parts 35D and 35E along a direction where the plurality of photoconductive drums 7A are arranged (i.e., in the front-and-rear direction according to the exemplary embodiment). Therefore, positioning of the sheet supplying frame 25 with respect to the main frames 21A and 21B can be done in the front-and-rear direction.

Figure 7:
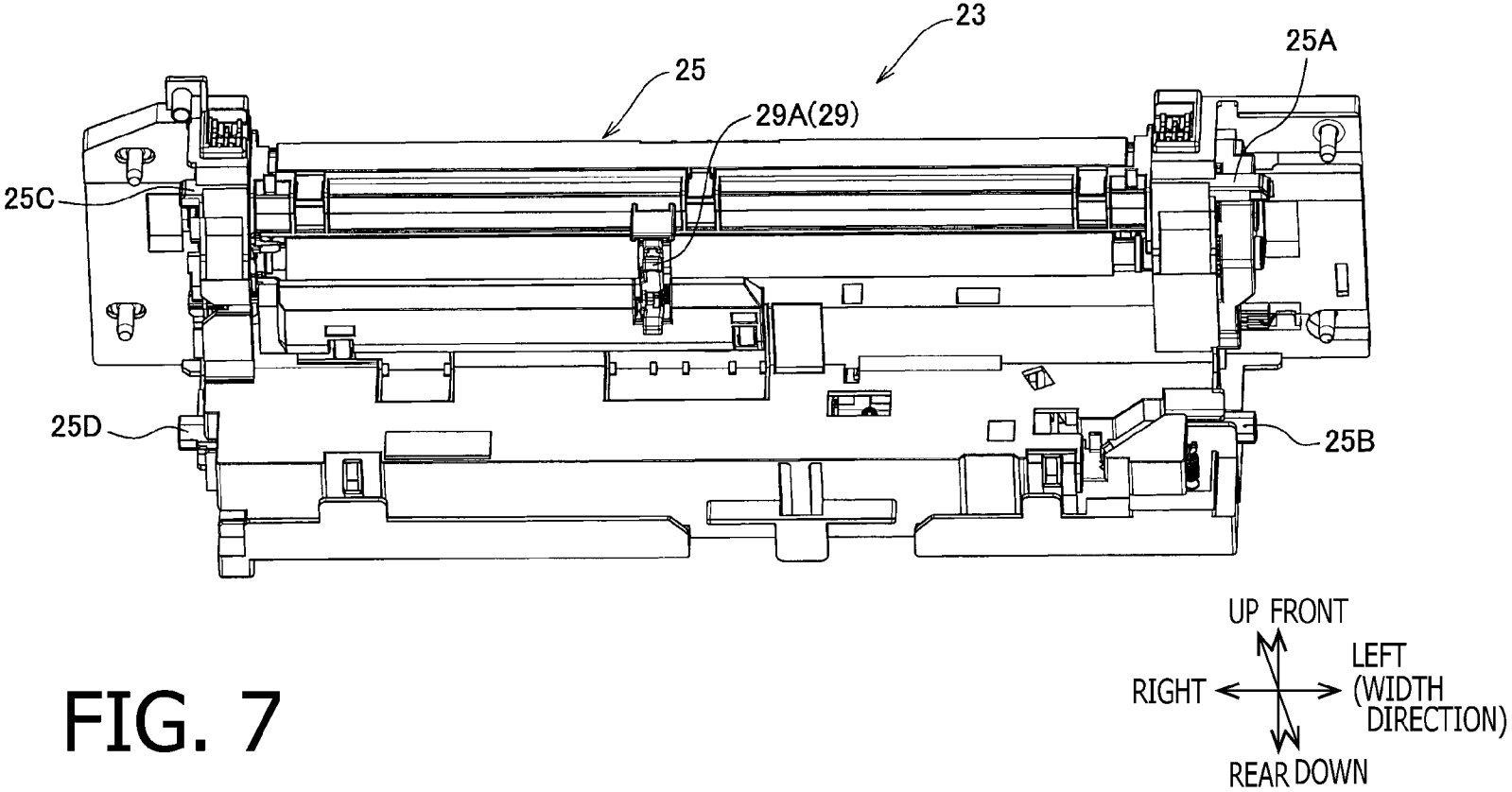
FIG. 7 is a perspective view of the sheet feeding unit according to the exemplary embodiment of the invention.

The first contact parts 25A and 25B are formed on a one longitudinal end portion (a first end portion) of the sheet supplying frame 25 which extends in the width direction as shown in FIG. 7. The second contact portions 25C and 25D are formed on the other end portion (a second end portion) of the sheet supplying frame 25.

The first contact parts 25A and 25B and the second contact part 25C and 25D are formed as protruded parts which protrude from the sheet supplying frame 25 in the width direction as shown in FIG. 6. According to the exemplary embodiment, the first contact parts 25A and 25B and the second contact parts 25C and 25D are made of resin and formed integrally with the sheet supplying frame 25.

A projected amount of at least the first contact part 25A between the first contact parts 25A and 25B is greater than the projected amount of at least the second contact part 25C between the second contact parts 25C and 25D.

Further, the first contacting parts 31A and 33A, and the second contacting parts 35D and 35E are provided on side walls of recesses 31B, 33B, 35F and 35G, which are recessed in the width direction, respectively. It is noted that the side walls of the recesses 31B, 33B, 35F and 35G are walls which are parallel with the recessed direction, or the width direction. In FIGS. 4 and 5, the first contacting parts 31A and 33A and the second contacting parts 35D and 35E are indicated by hatching.

At a root portion of the first contact part 25A, as shown in FIGS. 3 and 6, a reinforcing parts 25E which reinforce the root portion of the first contact part 25A are formed. The reinforcing parts 25E have wall surfaces which are parallel with a protruded direction of the first contact part 25A.

The reinforcing parts 25E surround at least a part of the first contact part 25A. According to the exemplary embodiment, the reinforcing parts 25E and the first contact part 25A are formed integrally with the sheet supplying frame 25.

On the first frame 31, as shown in FIG. 4, a positioning part 33C is formed. The positioning part 33C is used to position the sheet supplying frame 25 in a direction where the surfaces of the first frame 31 intersect, or the width direction.

According to the exemplary embodiment, the positioning part 33C is, as shown in FIG. 2, a projection protruded from the first body frame 33 toward the sheet supplying frame 25. The sheet supplying frame 25 is formed with a position part 25F which is a recess or a through opening in which the positioning part 33C is fitted.

According to the exemplary embodiment, the positioning part 33C is not a part integrally formed with the first frame 31, but a part integrally formed with the first body frame 33, which is made of resin. Further, according to the exemplary embodiment, the first body frame 33 is coupled to the first frame 31, the positioning part 33C is provided to the first frame 31.

Characteristic Features

According to the exemplary embodiment, the sheet supplying frame 25 contacts the first contacting part 31A, the second contacting parts 35D and 35E which are formed on the first frame 31 and the second frame 35, respectively, and a relative position with respect to the first frame 31 and the second frame 35 is determined.

Since the first frame 31 is made of metal, the position of the sheet supplying frame 25 is determined by the first frame 31 which has higher rigidity than the second frame 35. Therefore, according to the exemplary embodiment, positioning accuracy of the sheet supplying frame 25, reduction of manufacturing cost, reasonable design freedom and productivity can be realized.

Further, the second frame 25 made of resin has a higher design freedom and productivity than the first frame 31 made of metal. On the other hand, resin generally has low tensile strength than metal. Therefore, it is reasonable that a protruded length L1 of the first contact part 25A is greater than a protruded length L2 of the second contact part 25C.

According to the exemplary embodiment, the second resin part 35B, which has a higher tensile strength than the first resin part 35A, is formed with the second contacting parts 35D and 35E. With this structure, positioning accuracy of the sheet supplying frame 25 can be realized with reserving necessary strength.

Further, according to the exemplary embodiment, a positioning part 33C which determines the position of the sheet feed frame 25 in the width direction is provided to the first frame 31. Since the position of the sheet feed frame 25 in the width direction is defined with reference to the first frame 31 having a high rigidity, the positional accuracy of the sheet feed frame 25 is maintained.

OTHER EMBODIMENTS

In the exemplary embodiment described above, the second frame 25 includes the first resin part 35A and the second resin part 35B. However, the invention need not be limited to such a feature, and can by modified in various ways. For example, the second frame 35 may be configured with the same resin. Alternatively, the portion corresponding to the first resin part 35A and the portion corresponding to the second resin part 35B may be formed integrally by coinjection molding.

According to the exemplary embodiment, the resin plate part 39 is coupled on the main frame 21B side of the first frame 31. The invention need not be limited to such a configuration and can be modified in various ways. For example, the plate part 39 and the first frame 31 may be formed integrally by providing the securing part 39A to the first frame 31, or by employing an insert molding method.

According to the exemplary embodiment, the positioning part 33C is provided to the first frame 31 via the first body frame 33. It is noted that the invention need not be limited to such a configuration and can be modified in various ways. For example, the positioning part 33C may be formed on the first frame 31 integrally. In such a case, the positioning part 33C may be formed as a recess or a through opening, and the position part 25F may be formed as a protrusion.

According to the exemplary embodiment, the first contacting part 33A is provided to the first frame 31 via the first body frame 33. The invention need not be limited to such a configuration, and can by modified in various ways. For example, the first contacting part 33A may be provided integrally to the first frame 31.

According to the exemplary embodiment, the reinforce part 25E is formed at a root portion of the first contact part 25A. However, the invention need not be limited to such a configuration, and can by modified in various ways. For example, reinforce parts may be formed at root portions of other contact parts 25B-25D. Alternatively, the reinforce part 25E may be omitted.

It is noted that the image forming apparatus according to the exemplary embodiment employs a so-called direct method in which developing agents are directly transferred from photoconductive drums to a sheet. However, the invention need not be limited to such a configuration, and an image forming apparatus employing an intermediate transfer method, in which the developing agent is once transferred from the photoconductive drums to a transfer belt, and then transferred onto a sheet, or an image forming apparatus employing an inkjet printing method.

It is noted that the scope of the invention is set forth in claims, and the above-described embodiment is only an exemplary embodiment and is not intended to limit the scope of the invention.

What is claimed is:

1. An image forming apparatus, comprising:

a sheet supply tray accommodating sheets;

an image forming unit configured to form an image on the sheet supplied from the sheet supply tray;

a first frame made of metal, the first frame being configured to support the image forming unit, the first frame comprising a first recessed part made of metal; and a second frame arranged on an opposite side, with respect to the image forming unit, of the first frame, the second frame comprising a first resin part made of first resin and a second resin part made of second resin which has a higher tensile strength than the first resin, the second resin part comprising a second recessed part; and a sheet supplying unit having sheet feed rollers configured to pick up and feed a sheet from the sheet supply tray, the sheet supplying unit bridging between the first frame and the second frame, the sheet supplying unit being positioned above the sheet supply tray, the sheet supplying unit comprising:

a first projected part configured to contact the first recessed part made of metal and thereby position the sheet supplying unit with respect to the first frame made of metal; and a second projected part, a protruded length of the second projected part being shorter than a protruded length of the first projected part, the second projected part being configured to contact the second recessed part, which is made of the second resin, and thereby position the sheet supplying unit with respect to the second frame.

2. The image forming apparatus according to claim 1, wherein a positioning part used to position the sheet supplying unit in a direction which is perpendicular to two surfaces of the first frame is provided to the first frame.

3. The image forming apparatus according to claim 1, wherein a reinforcing part is provided to a root portion of each of the first and second projected parts to reinforce the root portions.

4. The image forming apparatus according to claim 1, which employs an electro photographic image forming process and has a plurality of photoconductive drums.

5. An image forming apparatus, comprising:

a sheet supply tray accommodating sheets;

an image forming unit configured to form an image on the sheet supplied from the sheet supply tray;

a first frame made of metal, the first frame being configured to support the image forming unit, the first frame comprising a first recessed part; and a second frame arranged on an opposite side, with respect to the image forming unit, of the first frame, the second frame comprising a first resin part made of first resin and a second resin part made of second resin which has a higher tensile strength than the first resin, the second resin part comprising a second recessed part; and a sheet supplying unit having sheet feed rollers configured to pick up and feed a sheet from the sheet supply tray, the sheet supplying unit bridging between the first frame and the second frame, the sheet supplying unit being positioned above the sheet supply tray, the sheet supplying unit comprising:

a first projected part configured to contact the first recessed part made of metal and thereby position the sheet supplying unit with respect to the first frame made of metal; and a second projected part, a protruded length of the second projected part being shorter than a protruded length of the first projected part, the second projected part being configured to contact the second recessed part, which is made of the second resin, and thereby position the sheet supplying unit with respect to the second frame;

wherein a positional accuracy of the sheet supplying unit in a width direction of the image forming apparatus is maintained by the rigidity of the first frame.

* * * * *